US006081232A

United States Patent [19]

Pittman et al.

[11] Patent Number: 6,081,232

[45] Date of Patent: Jun. 27, 2000

[54] COMMUNICATION RELAY AND A SPACE-FED PHASED ARRAY RADAR, BOTH UTILIZING IMPROVED MACH-ZEHNDER INTERFEROMETER

[75] Inventors: William C. Pittman, Huntsville; Paul R. Ashley, Toney, both of Ala.

[73] Assignee: The United States of America as represented by the Secretary of the Army, Washington, D.C.

[21] Appl. No.: 09/110,276

[22] Filed: Jul. 6, 1998

[51] Int. Cl.[7] ..... H01Q 3/22

[52] U.S. Cl. ..... 342/368; 342/200

[58] Field of Search ..... 342/424, 368, 342/374, 200

[56] References Cited

U.S. PATENT DOCUMENTS

| | | | |
|---|---|---|---|
| 4,028,702 | 6/1977 | Levine | 343/100 |
| 4,725,844 | 2/1988 | Goodwin et al. | 342/374 |
| 4,739,334 | 4/1988 | Soref | 342/368 |

*Primary Examiner*—Thomas H. Tarcza
*Assistant Examiner*—Fred H. Mull
*Attorney, Agent, or Firm*—Arthur H. Tischer; Hay Kyung Chang

[57] ABSTRACT

A space-fed phased array radar utilizes a network of improved Mach-Zehnder interferometers to provide a space-fed, optically controlled millimeter wave/microwave antenna array that is capable of either one-way or two-way transmission. In the two-way communication relay mode, both ends of the relay link can remotely switch from a transmit to a receive mode and vice versa while, at the same time, steering the outgoing radiation beams on both sides of the relay so as to achieve maximum signal-to-noise ratio between the two terminals (i.e. signal stations) of the communication link. The improvements include receiving antenna with beam-scanning capability to receive millimeter or microwave signals from a first signal station, amplifiers to amplify outgoing signals prior to being radiated outwardly by transmitting antenna and a means to render the same antenna array capable of being used in a two-way transmit and receive mode. Controlling in a prescribed manner the voltage or current that is applied to the optical signal determines the shape and direction of the outgoing signal radiated into space.

19 Claims, 4 Drawing Sheets

COMMUNICATION RELAY AND A SPACE-FED PHASED ARRAY RADAR, BOTH UTILIZING IMPROVED MACH-ZEHNDER INTERFEROMETER

DEDICATORY CLAUSE

The invention described herein may be manufactured, used and licensed by or for the Government for governmental purposes without the payment to us of any royalties thereon.

BACKGROUND OF THE INVENTION

The use of individual VHF antennas arrayed in a linear or two-dimensional spatial configuration with relative phasing between them designed to achieve a particular radiation pattern dates back to the turn of the century. World War II provided the stimulus for the development of microwave radar, but all microwave radars utilized in the war featured only mechanical scanning of the radiation beams for tracking and surveillance. However, the art of electronic scanning advanced rapidly after the first demonstration of a ferrite scanned array by Huggins in 1958. The potential of highly agile electronic beam steering for handling multiple radar functions including multiple target tracking was detected immediately and intensive follow-on development was begun by a number of research institutions. As a result, a variety of phase shifter types and element feeds have been developed over the years. More recently, the development of optical methods of controlling the phase of microwave and millimeter wave signals have been accomplished.

One notable achievement among these is "[E]lectro-optical beamforming network for phased array antennas" taught by Richard A. Soref in U.S. Pat. No. 4,739,334 (Apr. 19, 1988) whose disclosure is hereby incorporated by reference into subject application, particularly the portion appearing in columns 4, 5, 6 and 7 and pertaining to Soref FIGS. 2 and 3. In the Soref patent, an optical signal emanating from a coherent laser source is divided into two paths, each path containing an electro-optic phase modulator. A microwave signal is applied to the modulator in the first path to provide an offset to the optical frequency by the amount of the microwave frequency. A given voltage (i.e. phase control signal) is applied to the modulator in the second path to phase-modulate (i.e. produce a specific amount of optical phase retardation) the optical signal traveling in that path. The optical signals from the two paths are, then, recombined on a photodetector which recovers the frequency difference between the two optical signals (i.e. the microwave frequency), now modulated by the phase that was imparted to the optical signal in the second path. In essence, the phase modulation imparted to the optical signal in the second path is transferred as phase modulation to the microwave signal. The mathematical expressions of these operations are presented in FIG. 2 of the Soref patent.

SUMMARY OF THE INVENTION

The communication relay and the space-fed phased array radar, both utilizing improved Mach-Zehnder interferometer, adopt the electro-optical beamforming network for phased array antennas as taught by Richard A. Soref in the above-cited U.S. patent and improve thereupon to provide a communication relay antenna capable of either one-way or two-way transmission and a space-fed, optically controlled millimeter wave/microwave radar antenna array. In the two-way communication relay mode, both ends of the relay link can remotely switch from a transmit to a receive mode and vice versa while at the same time steering the outgoing radiation beams on both sides of the relay so as to achieve maximum signal-to-noise ratio between the two terminals (i.e. signal stations) of the communication link. The improvements include receiving antenna with beam-scanning capability to receive millimeter or microwave signals from a first signal station, amplifiers to amplify outgoing signals prior to being radiated outwardly by transmitting antenna and a means to render the same antenna array capable of being used in a two-way transmit and receive mode.

DESCRIPTION OF THE PREFERRED EMBODIMENTS

Figure 1:
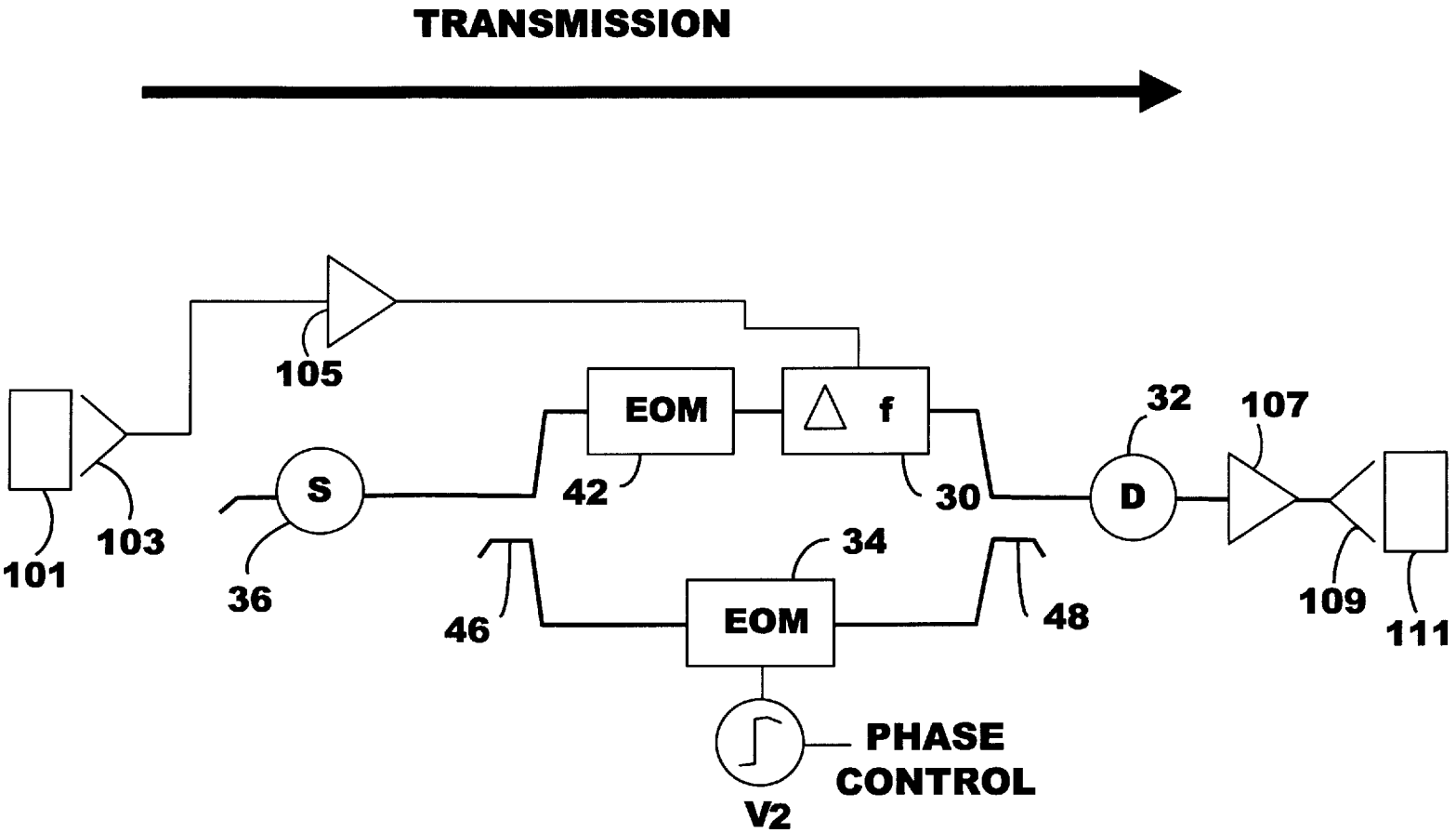
FIG. 1 depicts a communication relay array for left-to-right transmission.

Referring now to the drawing wherein like numbers represent like parts in each of the several figures, further explained are the structure and operation of the communication relay and the space-fed phased array radar utilizing improved Mach-Zehnder interferometer.

Figure 2:
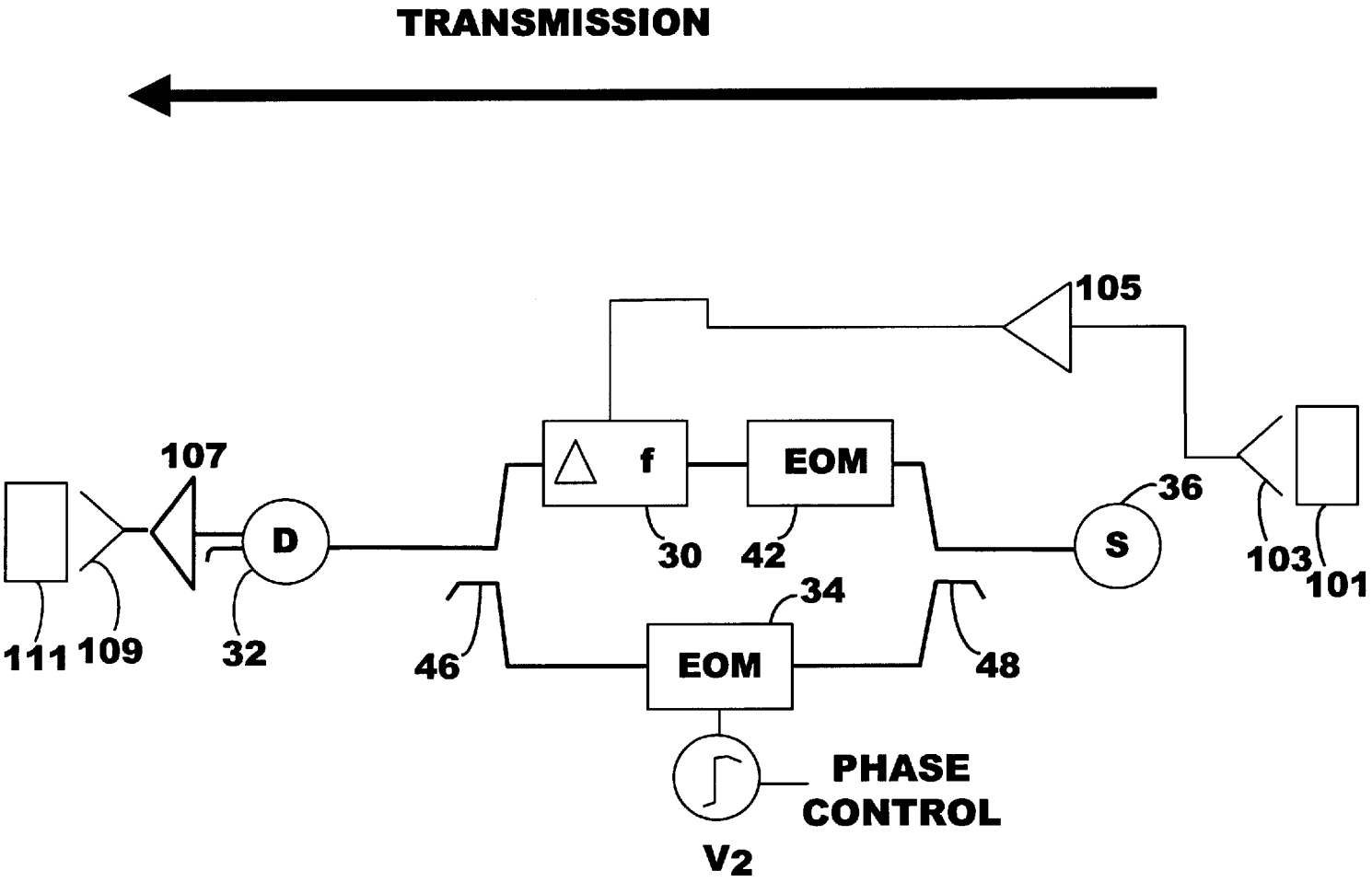
FIG. 2 depicts a communication relay array for right-to-left transmission.

FIGS. 1 and 2 show the circuit arrangement for one improved Mach-Zehnder interferometer for the left-to-right transmission and one improved Mach-Zehnder interferometer for the right-to-left transmission, respectively. These two depicted interferometers, except for the reversal of the transmission direction, have like components and function in a like fashion. To wit, an RF signal of a given frequency (millimeter or microwave), transmitted by a distant transmitter such as first signal station 101, is received by first antenna 103 having beam scanning capability. Then, following amplification by first amplifier 105, the RF signal is input to single sideband optical frequency shifter 30. Here the RF signal combines with the optical signal that originates from coherent source 36 and travels through first electro-optical modulator 42 in the upper arm of the Mach-Zehnder circuit, the combination yielding a first optical output signal described by $$\mathrm{Cos}(W_o+W_r)t.$$

Meanwhile, the portion of the optical signal originating from the coherent source 36 and traveling through second electro-optical modulator 34 in the lower arm of the Mach-Zehnder circuit is modulated by a phase control signal that imparts to the optical signal steering information, producing a phase-controlled signal described by $$\mathrm{Cos}(W_0-0(v)).$$

The phase modulation optimizes the signal-to-noise ratio of the beam ultimately to be radiated outwardly by second antenna 109.

The first output signal from frequency shifter 30, $$\mathrm{Cos}(W_o+W_r)t$$

is then fed into first detector 32 where it is mixed with the phase-controlled signal, $\mathrm{Cos}(W_0-0(v))$, that flows to the detector through first coupler 48 from the lower arm of the Mach-Zehnder circuit. The mixing process yields the difference frequency, $W_r$, between the upper and lower arms. This difference frequency, $W_r$, is recovered in the detector along with the phase modulation imparted to the optical signal in the lower arm to give outgoing signal, $$\mathrm{Cos}(W_r t-0(v)).$$

The outgoing signal is, then, amplified by third amplifier 107 and radiated outwardly by second antenna 109 toward second signal station 111 in a pre-determined direction in accordance with the steering information imparted by the phase control signal.

Figure 3:
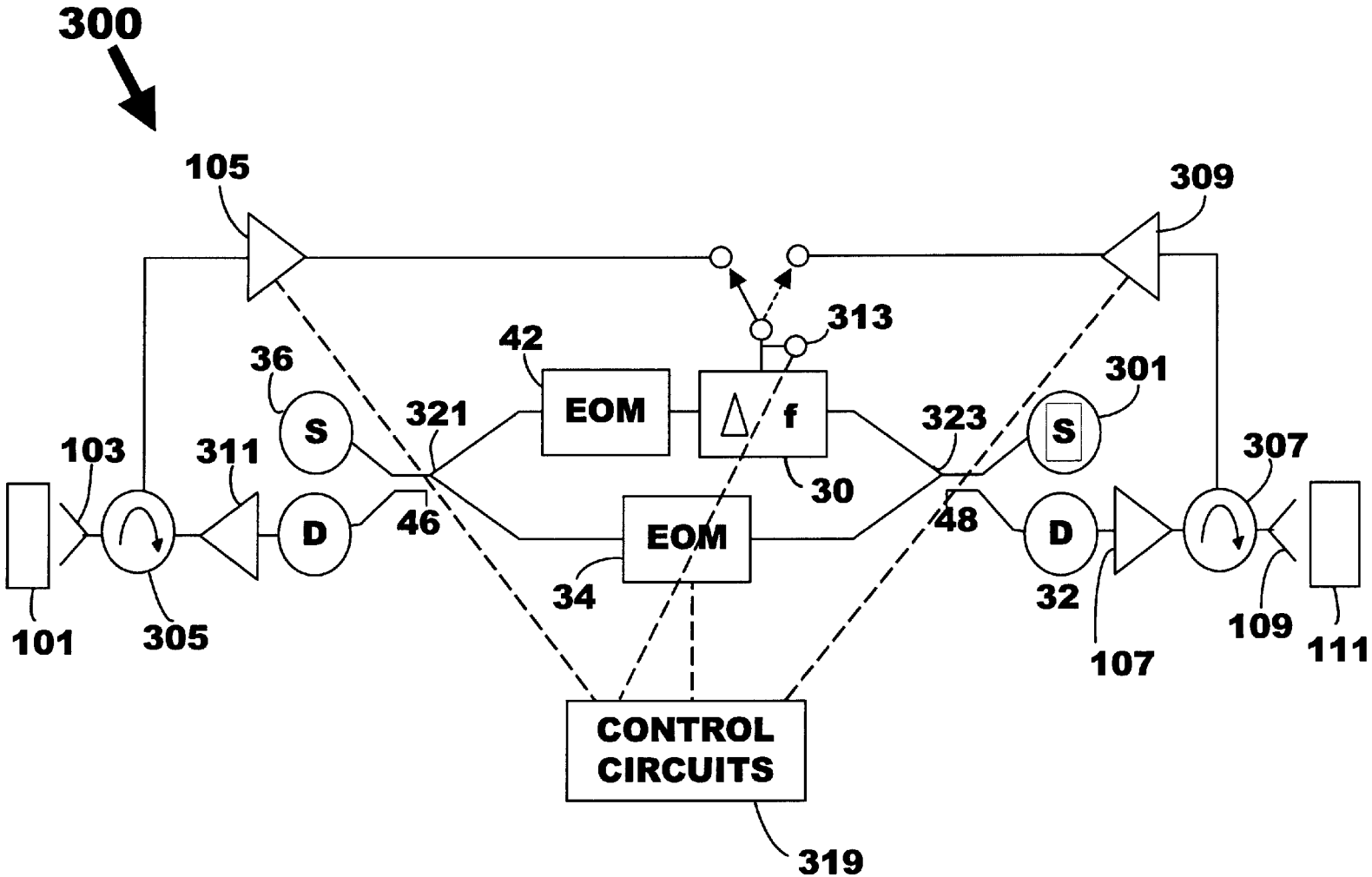
FIG. 3 shows a communication relay that uses the same antenna arrays for two-way transmit and receive operation.

FIG. 3 depicts a two-way transmission embodiment 300 for performing the transmit and receive communication relay functions illustrated by the very direction-specific FIGS. 1 and 2 but while using the same antenna array for both directions.

In this embodiment wherein each of the modulators is a reversible modulator, a left-to-right communication relay is activated when first antenna 103, having beam scanning capability, is set in a receiving mode (via remote control from first signal station 101, not illustrated here) and a coded microwave or millimeter wave signal is received on the first antenna from station 101. The received signal is, then, routed by first circulator 305 to first amplifier 105 where, in response to the received signal, a triggering signal is sent to control circuit 319. Thereupon, the control circuit, which is simultaneously coupled (the coupling illustrated by dashed lines in the figure) to the first amplifier, optical switch 313, second electro-optical modulator 34 and second amplifier 309, responds to the triggering signal and causes optical switch 313 to be set so as to allow the amplified received signal to travel from the first amplifier to frequency shifter 30. As described above with regard to FIGS. 1 and 2, the millimeter or microwave signal is combined in the shifter with the optical signal generated by coherent beam source 36, resulting in first optical output signal, $\mathrm{Cos}\,(W_0+W_r)t$. In the meantime, a portion of the optical signal originating from coherent beam source 36 travels via second coupler 46 to second modulator 34 which, in response to control circuit 319, provides a pre-selected phase control signal by applying the appropriate voltage, thereby producing $\mathrm{Cos}\,(W_0-0(v))$. The first optical output signal $\mathrm{Cos}\,(W_0+W_r)t$ from the uppper arm of the Mach Zehnder circuit is mixed with the phase-controlled optical signal, $\mathrm{Cos}\,(W_0-0(v))$, from the lower arm in first detector 32 to yield the outgoing signal, $\mathrm{Cos}\,(W_r t-0(v))$. This outgoing signal is then amplified and routed by third amplifier 107 and second circulator 307, respectively, prior to being radiated outwardly by second antenna 109.

Just as in FIGS. 1 and 2, the phase information to provide the steering direction of the outgoing signal is contained in the term, 0(v). Control circuit 319 contains therein a program that imparts pre-selected, varied values of 0(v) to the optical beam traveling via second modulator 34: 0, (v), 2(v), 3(v) - - - to execute a search sequence to locate second signal station 111 for right-to-left transmission (or first signal station 101 for left-to-right transmission). The reception of the search sequence at the second signal station triggers transmission of response from the second station which is received by second antenna 109 and flows through second circulator 307 and is amplified in second amplifier 309. The amplified response signal is then fed to control circuit 319 where the signal-to-noise ratio is sampled. The search sequence is executed until the maximum signal-to-noise ratio is found and, at this point, the search sequence is switched to a track sequence to maintain the link at the maximum signal-to-noise ratio. The information-bearing part of the outgoing signal, $\mathrm{Cos}\,(W_r t-0(v))$ is carried by $W_r$. For example, if $W_r$ were frequency-modulated, the outgoing signal could become $\mathrm{Cos}\,(W_r+B\cos W_m t-0(v))$, where B is the amplitude of the frequency modulation on $W_r$ and $W_m$ is the modulation frequency carrying the information being transmitted from the first signal station to the second signal station and is much higher in frequency than the beam-steering information carried by 0(v). The first source of coherent beam is coupled to the first and second modulators via first Y-junction 321 and second source of coherent beam 301 is coupled to the frequency shifter and the second modulator via second Y-junction 323.

For right-to-left communication relay, the activation of the process occurs when second antenna 109 is set via remote control from second signal station 111 (not illustrated here) in a receiving mode. When a coded microwave or millimeter wave signal is received on the second antenna from second signal station 111, it is routed to second amplifier 309. Control circuit 319, then, causes optical switch 313 to change its position so as to allow the amplified received signal to be input from second amplifier 309 to frequency shifter 30. Thereafter, signal processing continues with input from second coherent beam source 301 in a manner similar to that described above for left-to-right communication relay until the outgoing signal is radiated outwardly via first antenna 103.

The embodiment depicted in FIG. 3 greatly reduces the number of bulkier and more expensive components of the antenna array and renders the array more suitable for use as a payload on a light-weight unmanned aerial vehicle or balloon. Further, the array may be designed so that one coherent beam source serves a plurality of pairs of modulators.

Figure 4:
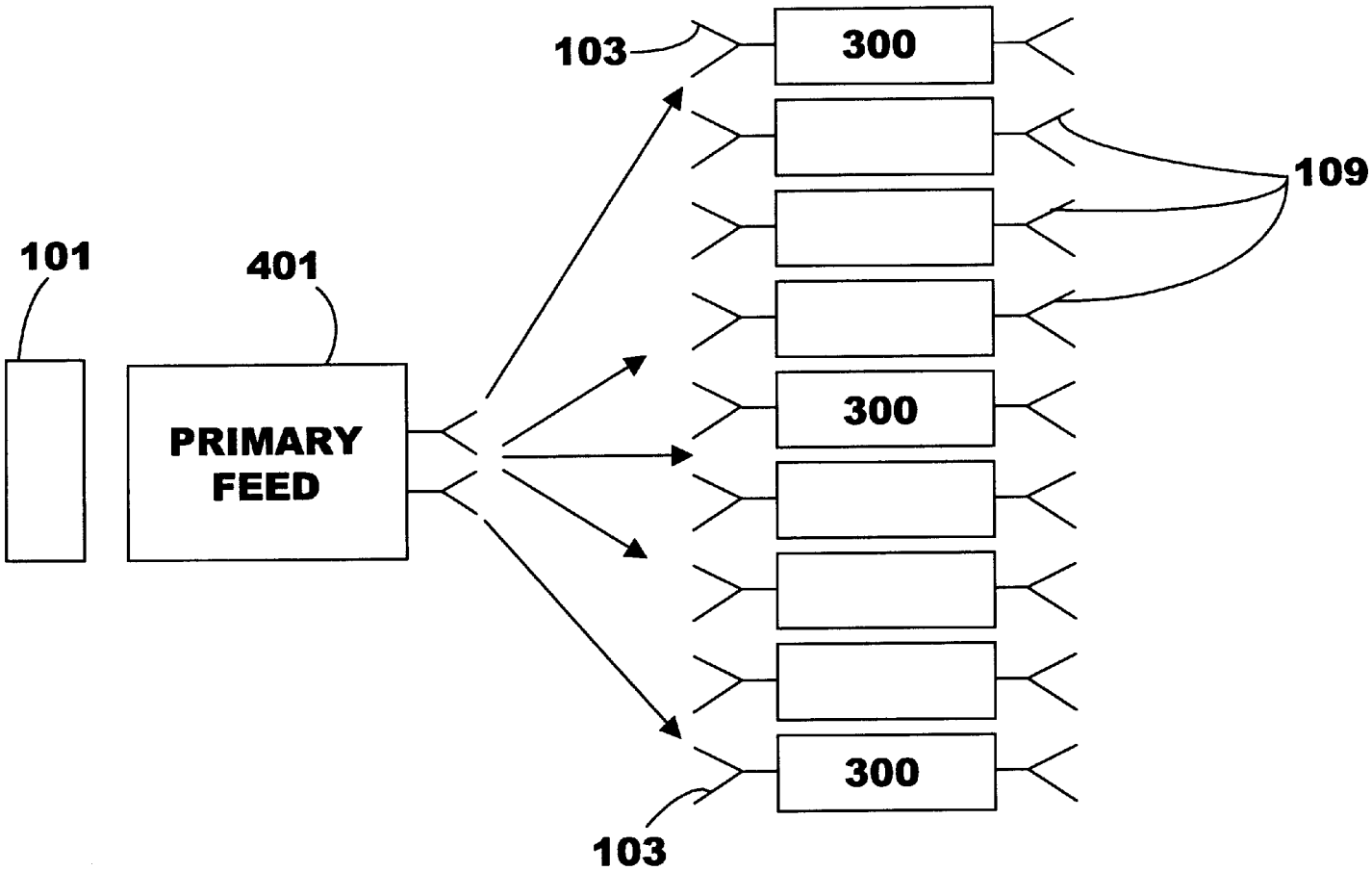
FIG. 4 is a diagram of a space-fed antenna array utilizing the two-way transmit-and-receive configuration of FIG. 3.

FIG. 4 illustrates an alignment of a multiple of two-way communication relay units as depicted in FIG. 3 to provide a space-fed phased array radar utilizing improved Mach-Zehnder interferometers. The first antennas 103 of the relay units, which are in close proximity of each other, are located at a fixed distance away from primary feed 401 that is optimized to give efficient aperture illumination with minimum spillover and is positioned to relay a radar signal of frequency $W_r$ from first signal station 101 to the first antennas. This obviates the need to equip the first antennas with beam scanning capability though such capability is still advised for second antennas 109. The first antennas, however, are equipped to correct for the spherical wavefront from the primary feed. Further, because of the close proximity of first antennas to each other, first amplifiers 105 are not required for the space-fed radar array. But third amplifiers 107 are required to be higher-powered than fourth amplifiers 311 because the third amplifiers may be amplifying relatively weak return echoes from, for example, targets. Each of the multiple communication relay units comprising the space-fed array radar operates in the manner described for the two-way unit depicted in FIG. 3.

Although a particular embodiment and form of this invention has been illustrated, it is apparent that various modifications and embodiments of the invention may be made by those skilled in the art without departing from the scope and spirit of the foregoing disclosure. Accordingly, the scope of the invention should be limited only by the claims appended hereto.

We claim:

1. In a Mach-Zehnder interferometer commonly used in an electro-optical beamforming network for phased array antennas, the interferometer having a first and a second electro-optical phase modulators, a source of coherent beam positioned to supply optical signals to the modulators, a frequency shifter for receiving therein the modulated optical signals from the first modulator, a voltage source connected to the second modulator to provide phase control to the optical signals travelling through the second modulator, a detector coupled to the shifter, the detector being further coupled to the second modulator via a coupler; an improvement to the Mach-Zehnder interferometer to render the interferometer suitable for use in an antenna system having optical control of beam direction and employing at least a pair of such improved Mach-Zehnder interferometers, the interferometers having identical elements but different pre-determined beam propagation directions, said improvement to each Mach-Zehnder interferometer comprising: a receiving antenna having beam scanning capability for receiving signals from a distant transmitter; a first amplifier coupled between said receiving antenna and the frequency shifter, said first amplifier providing gain control to the received signals and the shifter mixing the amplified received signals with the coherent beam from the beam source to produce an output signal, said output signal thereafter being input to the detector wherein said output signal is combined with phase-controlled optical signals from the second modulator to yield an outgoing signal having a pre-determined direction of propagation; a transmit antenna for transmitting said outgoing signal and a second amplifier coupled between the detector and said transmit antenna for amplifying said outgoing signal prior to transmission.

2. An improvement as set forth in claim 1, wherein said pair of improved Mach-Zehnder interferometers propagate outgoing signals in different directions.

3. An improvement as set forth in claim 2, wherein the propagation direction of each of said pair of improved Mach-Zehnder interferometers is determined independently of the other.

4. A transmit and receive communication system utilizing a Mach-Zehnder interferometer having a frequency shifter, a first and a second electro-optical phase modulators, a first source of coherent beam, the first modulator being coupled between the frequency shifter and the first source and the first source being positioned to supply coherent optical signals to the modulators and the frequency shifter, a voltage source connected to the second modulator to provide variable phase control to the optical signals traveling through the second modulator so as to determine the direction of beam propagation, a first detector coupled to the shifter, the detector being further coupled to the second modulator; an improvement to render the system capable of two-way communication using the same antenna array while having beam direction control, said improvement comprising: reversibility of the modulators; a first antenna having beam scanning capability, said first antenna being adapted for selective transmission and reception of signals to and from a first signal station; a first and a second amplifiers; a switching means simultaneously coupled between said first and second amplifiers and the shifter; a control circuit, said circuit being connected in parallel to said first and second amplifiers, said switching means and to the second reversible modulator, said switching means coupling signals selectively from said first amplifier or second amplifier to the frequency shifter in response to control signals received from said control circuit; a first circulator coupled between said first antenna and said first amplifier to route signals received by said first antenna to said first amplifier wherein the received signal is provided with gain control prior to being input to the frequency shifter, the shifter mixing the amplified received signals with the coherent beam from the first source to produce a first output signal, said first output signal thereafter being input to the first detector wherein said first output signal is combined with phase-controlled optical signals from the second reversible modulator to yield a first outgoing signal having a first pre-determined direction of propagation; a second antenna having beam scanning capability, said second antenna being adapted for selective transmission and reception of signals to and from a second signal station; a second circulator coupled to receive said first outgoing signal from the first detector and route said first outgoing signal to said second antenna for ultimate radiation therefrom in a first pre-determined direction to said second signal station; a second coherent beam source positioned to supply coherent optical signals to the modulators and the frequency shifter, the shifter mixing coherent beam from said second source with signals received from said second signal station to produce a second output signal; a second detector coupled simultaneously to the first and second reversible modulators and said first circulator, said second detector receiving therein said second output signal from the shifter and combining said second output signal with phase-controlled optical signals from the second reversible modulator to yield a second outgoing signal having a second pre-determined direction of propagation, said second outgoing signal being input to said first antenna via said first circulator for ultimate transmission therefrom in a second pre-determined direction to said first signal station.

5. A transmit and receive communication system as set forth in claim 4, wherein said system further comprises a third amplifier coupled between the first detector and said second circulator.

6. A transmit and receive communication system as set forth in claim 5, wherein said system still further comprises a fourth amplifier coupled between said second detector and said first circulator.

7. A transmit and receive communication system as set forth in claim 6, wherein said first and second antennas transmit or receive in response to commands emanating from said first signal station and second signal station, respectively.

8. A transmit and receive communication system as set forth in claim 7, wherein said control circuit selectively varies the position of said switching means in response to input from said first and second amplifiers such that said switching means enables signals from said first and second amplifiers to travel to the frequency shifter.

9. A transmit and receive communication system as set forth in claim 8, wherein the first source of coherent beam is coupled to the first and second modulators via a first Y-junction and said second source of coherent beam is coupled to the shifter and the second modulator via a second Y-junction.

10. A transmit and receive communication system as set forth in claim 9, wherein said switching means is an optical switch.

11. A space-fed phased array radar with optical beam control, said radar comprising: a plurality of improved Mach-Zehnder interferometers and a primary feed positioned to relay signals between a distant transmitter and said improved interferometers, each of said improved interferometers having a frequency shifter; a first and a second reversible electro-optical phase modulators; a first source of coherent beam, the first reversible modulator being coupled between the frequency shifter and the first source and the first source being positioned to supply coherent optical signals to the modulators and the frequency shifter; a voltage source connected to the second reversible modulator to provide variable phase control to the optical signals traveling through the second modulator so as to determine the direction of beam propagation; a first detector coupled to the frequency shifter, the detector being further coupled to the second reversible modulator; a first antenna adapted for selective transmission and reception of signals to and from said primary feed; a first and a second amplifiers; a switching means simultaneously coupled between said first and second amplifiers and the frequency shifter; a control circuit, said circuit being connected in parallel to said first and second amplifiers, said switching means and to the second reversible modulator, said switching means coupling signals selectively from said first amplifier or second amplifier to the frequency shifter in response to control signals received from said control circuit; a first circulator coupled between said first antenna and said first amplifier to route signals received by said first antenna to said first amplifier wherein the received signal is provided with gain control prior to being input to the frequency shifter, the shifter mixing the amplified received signals with the coherent beam from the first source to produce a first output signal, said first output signal thereafter being input to the first detector wherein said first output signal is combined with phase-controlled optical signals from the second reversible modulator to yield a first outgoing signal having a first pre-determined direction of propagation; a second antenna having beam scanning capability, said second antenna being adapted for selective transmission and reception of signals to and from a distant signal station; a second circulator coupled to receive said first outgoing signal from the first detector and route said first outgoing signal to said second antenna for ultimate radiation therefrom in a first pre-determined direction to said signal station; a second coherent beam source positioned to supply coherent optical signals to the modulators and the frequency shifter, the shifter mixing coherent beam from said second source with signals received from said signal station to produce a second output signal; a second detector coupled simultaneously to the first and second modulators and said first circulator, said second detector receiving therein said second output signal from the shifter and combining said second output signal with phase-controlled optical signals from the second reversible modulator to yield a second outgoing signal having a second pre-determined direction of propagation, said second outgoing signal being input to said first antenna via said first circulator for ultimate radiation therefrom in a second predetermined direction to said primary feed.

12. A space-fed phased array radar with optical beam control as set forth in claim 11, wherein said first antenna and said second antenna point in opposite directions.

13. A space-fed phased array radar as set forth in claim 12, wherein said plurality of improved Mach-Zehnder interferometers are arranged with respect to said primary feed in such a pattern that an equal distance is maintained between said primary feed and each of said first antennas.

14. A space-fed phased array radar as set forth in claim 13, wherein said primary feed is optimized to give efficient aperture illumination with minimum spillover.

15. A space-fed phased array radar as set forth in claim 14, wherein said plurality of first antennas have a means for correcting for the spherical wave front from said primary feed.

16. A space-fed phased array radar as set forth in claim 15, wherein said radar further comprises a third amplifier coupled between the first detector and said second circulator.

17. A space-fed phased array radar as set forth in claim 16, wherein said system still further comprises a fourth amplifier coupled between said second detector and said first circulator.

18. A space-fed phased array radar as set forth in claim 17, wherein said third amplifier is higher-powered than said fourth amplifier.

19. A space-fed phased array radar as set forth in claim 18, wherein said control circuit selectively varies the position of said switching means in response to input from said first and second amplifiers such that said switching means enables signals from said first and second amplifiers to travel to the frequency shifter in accordance with the selection made by said control circuit.

* * * * *